US006433705B2

(12) United States Patent
Yamazaki

(10) Patent No.: US 6,433,705 B2
(45) Date of Patent: Aug. 13, 2002

(54) MOVABLE BODY DETECTING/NOTIFYING SYSTEM

(75) Inventor: Takeshi Yamazaki, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/833,553

(22) Filed: Apr. 13, 2001

Related U.S. Application Data

(62) Division of application No. 09/325,543, filed on Jun. 4, 1999.

(30) Foreign Application Priority Data

Jun. 5, 1998 (JP) ..... 10-156984
Jun. 10, 1998 (JP) ..... 10-162653

(51) Int. Cl.[7] ..... G08B 1/01

(52) U.S. Cl. ..... 340/933; 340/901; 340/903; 340/904; 340/435; 340/436; 340/902

(58) Field of Search ..... 340/933, 901, 340/903, 904, 435, 436

(56) References Cited

U.S. PATENT DOCUMENTS

| | | | |
|---|---|---|---|
| 3,662,328 | A | 5/1972 | Spivak |
| 3,784,970 | A | 1/1974 | Simpkin |
| 5,289,181 | A | 2/1994 | Watanabe et al. |
| 5,572,201 | A | 11/1996 | Graham et al. |
| 5,710,556 | A | 1/1998 | Nishimura et al. |
| 6,049,295 | A | 4/2000 | Sato |

FOREIGN PATENT DOCUMENTS

| | | |
|---|---|---|
| DK | 4203930 | 3/1993 |
| DK | 4123857 | 4/1993 |
| EP | 0136956 | 4/1985 |
| EP | 0773524 | 5/1997 |
| JP | 2216600 | 8/1990 |
| JP | 7225274 | 8/1995 |

*Primary Examiner*—Jeffery Hofsass
*Assistant Examiner*—Hung Nguyen
(74) *Attorney, Agent, or Firm*—Birch Stewart Kolasch & Birch, LLP

(57) ABSTRACT

To provide a movable body detecting/notifying system that is capable of determining and reporting whether another movable body exists behind an obstruction or at a position that can be verified by the sense of sight. A movable body detecting/notifying system allows a detecting movable body to detect and report a detected movable body by using electromagnetic wave communication. The detected movable body transmits a large-wavelength electromagnetic wave easily diffractable by an obstruction as well as a small-wavelength electromagnetic wave not easily diffractable by an obstruction at the same time. The detecting movable body generates a notice for reception of only the large-wavelength electromagnetic wave without the small-wavelength electromagnetic wave or a notice for reception of both the large-wavelength and small-wavelength electromagnetic waves different from the notice for reception of only the large-wavelength electromagnetic wave.

3 Claims, 5 Drawing Sheets

MOVABLE BODY DETECTING/NOTIFYING SYSTEM

This application is a divisional of co-pending application Ser. No. 09/325,543, filed on Jun. 4, 1999, the entire contents of which are hereby incorporated by reference and for which priority is claims under 35 U.S.C. §120; and this application claimed priority of application No. Hei. 10-156984 and Hei 10-162653 filed on Japan on Jun. 5, 1998 and Jun. 10, 1998, respectively, under 35 U.S.C. §119.

BACKGROUND OF THE INVENTION

1. Field of the Invention

The present invention relates to a system and apparatus for detecting and reporting a movable body by using electromagnetic wave or radio communication.

2. Description of Related Art

A variety of conventional methods for detecting another approaching vehicle or another approaching movable body while the driver is driving a vehicle have been proposed so far.

For example, according to a method disclosed in Japanese Patent Laid-open No. Hei 2-216600, a vehicle is running while a receiver provided in the vehicle is monitoring incoming signals. Furthermore, a warning wave transmitted by a transmitter is installed on another movable body which is received by the receiver. A warning is then generated to notify the driver of the existence of the other movable body.

However, the number of movable bodies causing a warning is not known. Thus, in some cases, the existence of only one vehicle can be confirmed by the sense of eight or more vehicles. Therefore, it is difficult to verify the existence of other vehicles.

In order to solve this problem, there has been proposed a method as disclosed in Japanese Patent Laid-open No. Hei 7-225274. With this method, it is possible to determine whether only one movable body or a plurality of movable bodies exist within a predetermined distance by comparing an interval between rising edges of two consecutive pulses of a received signal and to display a result of the determination.

However, a moveable body detected may disappear from detection temporarily behind an obstruction such as another large-sized vehicle or a fence before appearing again.

In this case, when the movable body disappears behind the obstruction, the warning wave transmitted thereby can no longer be received, causing a warning generated by the wave to be halted. Thus, the driver may forget the existence of the movable body, being no longer alert.

In such a case, when the movable body disappearing from detection temporarily appears again, the movable body which no longer receives attention does reappear, generating a warning wave. As a result, the driver gets bewildered.

It is also difficult for the driver to immediately determine whether a warning is generated from a warning wave transmitted by a reappearing movable body or newly transmitted by another movable body.

By merely knowing the number of other movable bodies; however, the existence of a plurality of movable bodies still raises a problem in that when 2 or more vehicles can be verified by the sense of sight, it is quite within the bounds of possibility that another hidden vehicle still exists.

That is to say, it is impossible to form a judgment as to whether or not a vehicle exists behind an obstruction with a high degree of reliability.

SUMMARY OF THE INVENTION

It is thus an object of the present invention addressing the problem described above to provide a movable body detecting/notifying system that is capable of determining and reporting whether another movable body exists behind an obstruction or at a position that can be verified by the sense of sight.

In order to achieve the object of the present invention described above, according to a first embodiment of the present invention, a movable body detecting/modifying system allows a detecting movable body to detect and report a detected movable body by using electromagnetic wave communication. The detected movable body transmits a large-wavelength electromagnetic wave which is easily diffractable by an obstruction as well as a small-wavelength electromagnetic wave which is not easily diffractable by an obstruction at the same time. The detecting movable body generates a notice for reception of only the large-wavelength electromagnetic wave without the small-wavelength electromagnetic wave or a notice for reception of both the large-wavelength and small-wavelength electromagnetic waves which is different from the notice for reception of only the large-wavelength electromagnetic wave.

The reception of only the large-wavelength electromagnetic wave by the detecting movable body indicates that the small-wavelength electromagnetic wave is hindered by an obstruction and that the detected movable body is hidden under the shadow of the obstruction and the existence of the detected movable body can not be confirmed by the sense of sight. On the other hand, the reception of both the large-wavelength and small-wavelength electromagnetic waves by the detecting movable body indicates that the detected movable body is not hidden under the shadow of an obstruction and exists at a position that can be verified even by the sense of sight.

By generating notices different from each other for the two cases described above, the driver of the detecting movable body is capable of knowing whether another movable body is hidden by an obstruction or exists at a position that can be verified by the sense of eight.

Thus, the notice of the existence of another movable body behind an obstruction can be regarded as preparatory information which urges an action such as suspension of acceleration or a braking operation of the vehicle. On the other hand, the notice of the existence of another movable body at a position verifiable by the sense of sight is judged to be a waning which urges a deceleration or a halt of the vehicle.

According to a second aspect of the first embodiment of the present invention, a movable body detecting/notifying system allows a detecting movable body to detect and report a detected movable body by using electromagnetic wave communication with the movable body detecting/notifying system. The detected movable body transmits a small-wavelength electromagnetic wave which is not easily diffractable by an obstruction. A repeater receives the small-wavelength electromagnetic wave and adds a relay code and relays the small-wavelength electromagnetic wave in a particular direction. When the detecting movable body receives the small-wavelength electromagnetic wave, the detecting movable body determines whether or not a relay code has been added to the small-wavelength electromagnetic wave. Furthermore, the detecting movable body generates a notice for reception of a small-wavelength electromagnetic wave with no relay code added thereto or a notice for reception of a small-wavelength electromagnetic wave with a relay code added thereto different from the notice for reception of the small-wavelength electromagnetic wave with no relay code added thereto.

The reception of only the small-wavelength electromagnetic wave with a relay code added thereto can be judged to indicate that the detected movable body is hidden by an obstruction while reception of a small-wavelength electromagnetic wave with no relay code added thereto can be judged to indicate that the existence of the detected movable body can be verified by the sense of sight.

By generating notices different from each other for the two cases described above, the driver of the detecting movable body is capable of determining whether another movable body is hidden by an obstruction or exists at a position that can be verified by the sense of sight.

According to a third aspect of the first embodiment of the present invention, a movable body detecting/notifying system allows a detecting movable body to detect and report a detected movable body by using electromagnetic wave communication with the movable body detecting notifying system. The detecting movable body receives information on a position of the detected movable body from a traffic regulating center for grasping information on positions of movable bodies in a predetermined range. The detected movable body transmits a small-wavelength electromagnetic wave which is not easily diffractable by an obstruction. When the information on a position of the detected movable body proves that the detected movable body is moving in a particular direction, the detecting movable body generates a notice for reception of no small-wavelength electromagnetic wave or a notice for reception of the small-wavelength electromagnetic wave different from the notice for reception of no small-wavelength electromagnetic wave.

After the information on a position of the detected movable body received from the traffic regulating center indicates the existence of the detected movable body, reception of no small-wavelength electromagnetic wave can be judged to indicate that the detected movable body is hidden by an obstruction while reception of the small-wavelength electromagnetic wave can be judged to indicate that the existence of the detected movable body can be verified by the sense of sight.

By generating notices different from each other for the two cases described above, the driver of the detecting movable body is capable of determining whether another movable body is hidden by an obstruction or exists at a position that can be verified by the sense of sight.

According to a fourth aspect of the first embodiment of the present invention, a movable body detecting/notifying system allows a detecting movable body to detect and report a detected movable body by using electromagnetic wave communication with the movable body detecting/notifying system. The detected movable body transmits an electromagnetic wave. The detecting movable body receives the electromagnetic wave. Furthermore, the detecting movable body generates notices different from each other before and after a large change in detected intensity of the electromagnetic wave.

A low detected intensity of a received electromagnetic wave can be judged to indicate that the electromagnetic wave has been diffracted by an obstruction, by which the detected movable body is hidden. On the other hand, an increasing detected intensity can be judged to indicate that the detected movable body appears from a state hidden by an obstruction, with the position of the detected movable body becoming verifiable by the sense of sight.

By generating notices different from each other before and after a large change in detected intensity of an electromagnetic wave, the driver of the detecting movable body is capable of determining whether another movable body is hidden by an obstruction or exists at a position that can be verified by the sense of sight.

According to a fifth aspect of the first embodiment of the present invention a movable body detecting/notifying system includes an ID code identifying a movable body added to an electromagnetic wave generated by the movable body. By adding an ID code to an electromagnetic wave, it becomes possible to determine whether each of a plurality of other detected movable bodies is hidden by an obstruction or exists at a position that can be verified by the sense of sight from different notices.

It is another object of the present invention addressing the problem described above to provide a movable body detecting/notifying apparatus that is capable of warning a driver of the fact that another movable body has disappeared from detection temporarily behind an obstruction in order to keep the driver alert.

In order to achieve the object described above, a second embodiment of the present invention provides a movable body detecting/notifying apparatus which includes a receiving means for receiving an electromagnetic wave transmitted by another movable body, a pattern analyzing means for analyzing a variable pattern of a detected intensity of an electromagnetic wave received by the receiving means, a pattern storing means for storing a variable pattern of a detected intensity of an electromagnetic wave which is received by the receiving means when a movable body transmitting the electromagnetic wave disappears from detection behind an obstruction, a pattern-approximation determining means for comparing a variable pattern of a detected intensity of an electromagnetic wave analyzed by the pattern analyzing means with a variable pattern of a detected intensity of an electromagnetic wave stored in the pattern storing means in order to determine whether or not the variable pattern analyzed by the pattern analyzing means is approximate to the variable pattern stored in the pattern storing means, and a notification control means for controlling a notification means on the basis of a result of determination output by the pattern-approximation determining means.

The movable body detecting/notifying apparatus is characterized in that the notification control means drives the notification means to output a warning notification urging a caution when a result of determination produced by the pattern-approximation determining means indicates that a variable pattern of a detected intensity of an electromagnetic wave analyzed by the pattern analyzing means is approximate to a variable pattern of a detected intensity of an electromagnetic wave stored in the pattern storing means and stops a warning notification when the detected intensity of the electromagnetic wave is restored.

When a variable pattern of a detected intensity of an electromagnetic wave generated by another movable body is judged to be approximate to a variable pattern of a detected intensity of an electromagnetic wave which was obtained when the other movable body disappeared from detection and stored in advance in the pattern storing means, the other movable body is judged to disappear from detection temporarily and a warning is given to the driver. Thus, the driver is always made aware of the existence of the other movable body and is alert so that the driver will not get bewildered by the reappearance of the other movable body.

According to a second aspect of the second embodiment of the present invention, a movable body detecting/notifying apparatus, the notification control means halts a warning notification of the notification means after the warning notification has been continuing for a predetermined period of time.

Even when a warning notification is output after a movable body is determined to temporarily disappear from detection behind an obstruction, the disappearance is not always temporary. In such a case, the movable body may have gone to a by-road and never -appears again. Thus, the warning notification is halted after a predetermined period of time has lapsed, preventing the warning notification from being continued.

According to a third aspect of the second embodiment of the present invention, a movable body detecting/notifying apparatus includes a pattern-approximation determining means which has a frequency determining means for determining whether or not a variable pattern analyzed by the pattern analyzing means is judged to be approximate to a variable pattern stored in the pattern storing means frequently, i.e., whether or not the number of times a variable pattern analyzed by the pattern analyzing means is judged to be approximate to a variable pattern stored in the pattern storing means in a predetermined short period of time is large. If a variable pattern analyzed by the pattern analyzing means is judged to be approximate to a variable pattern stored in the pattern storing means frequently, i.e., if the number of times a variable pattern analyzed by the pattern analyzing means is judged to be approximate to a variable pattern stored in the pattern storing means in a predetermined short period of time is large, a sensitivity of the receiving mesas is reduced.

If a variable pattern analyzed by the pattern analyzing means is judged to be approximate to a variable pattern stored in the pattern storing means frequently, i.e., if the number of times a variable pattern analyzed by the pattern analyzing means is judged to be approximate to a variable pattern stored in the pattern storing means in a predetermined short period of time is large, a warning notification urging a caution will be repeated frequently, adversely causing awareness of the warning notification to be lost. In such a case, the sensitivity of the receiving means is reduced to decrease the number of times a variable pattern analyzed by the pattern analyzing means is judged to be approximate to a variable pattern stored in the pattern storing means.

According to a fourth aspect of the second embodiment of the present invention, a movable body detecting/notifying apparatus includes a pattern-approximation determining means which has a frequency determining means for determining whether or not a variable pattern analyzed by the pattern analyzing means is judged to be approximate to a variable pattern stored in the pattern storing means frequently, i.e., whether or not the number of times a variable pattern analyzed by the pattern analyzing means is judged to be approximate to a variable pattern stored in the pattern storing means in a predetermined short period of time is large. If a variable pattern analyzed by the pattern analyzing means is judged to be approximate to a variable pattern stored in the pattern storing means frequently, i.e., if the number of times a variable pattern analyzed by the pattern analyzing means is judged to be approximate to a variable pattern stored in the pattern storing means in a predetermined short period of time is large, a threshold value used by the notification control means as a criterion as to whether or not a detected intensity of an electromagnetic wave has been recovered is increased.

If a variable pattern analyzed by the pattern analyzing means is judged to be approximate to a variable pattern stored in the pattern storing means frequently, i.e., if the number of times a variable pattern analyzed by the pattern analyzing means is judged to be approximate to a variable pattern stored in the pattern storing means in a predetermined short period of time is large, a threshold value used by the notification control means as a criterion as to whether or not a detected intensity of an electromagnetic wave has been recovered is increased so as to prevent the warning notification urging a caution from being repeated.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
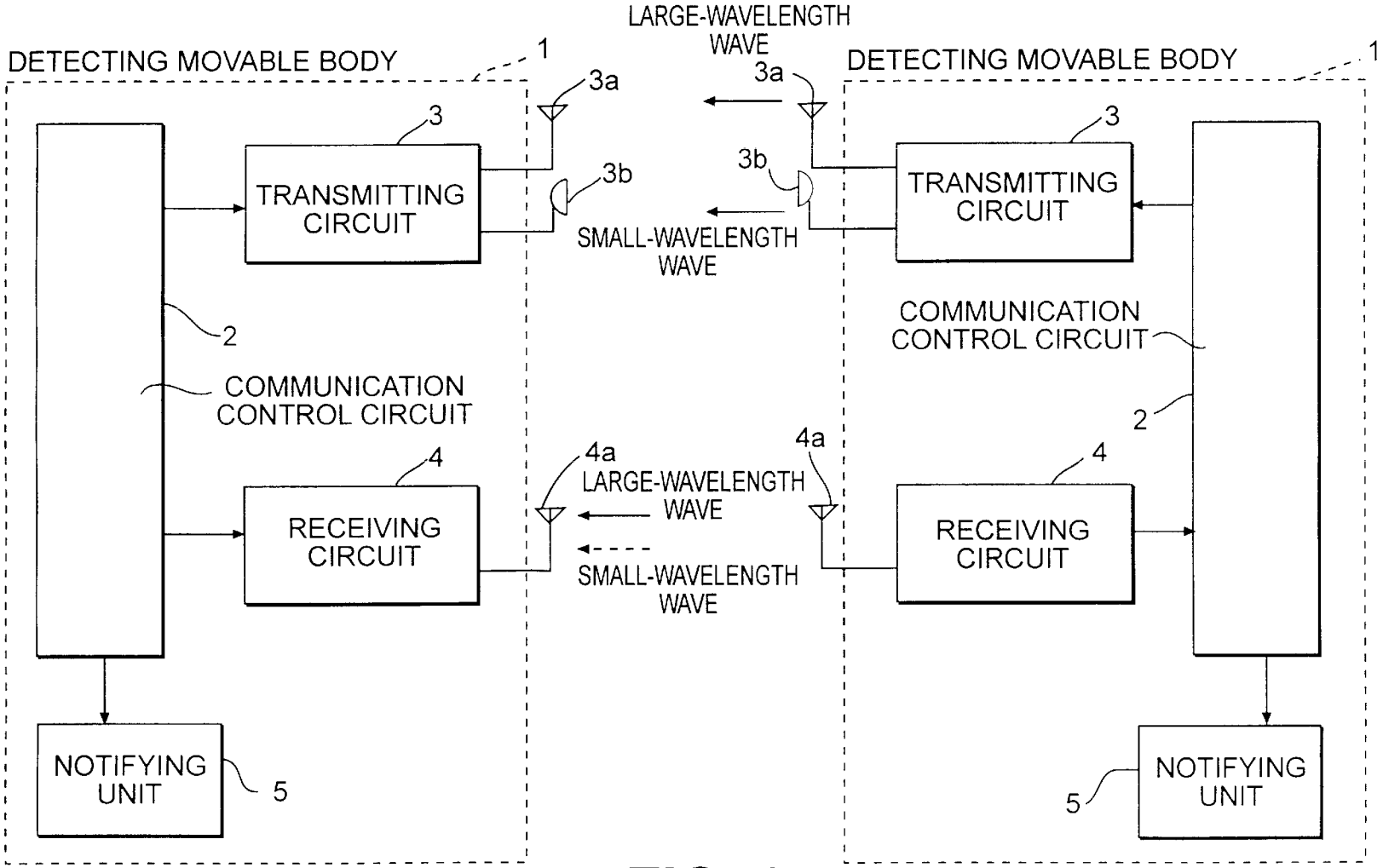
FIG. 1 is a block diagram illustrating a movable body detecting/notifying system according to the present invention.
Figure 2:
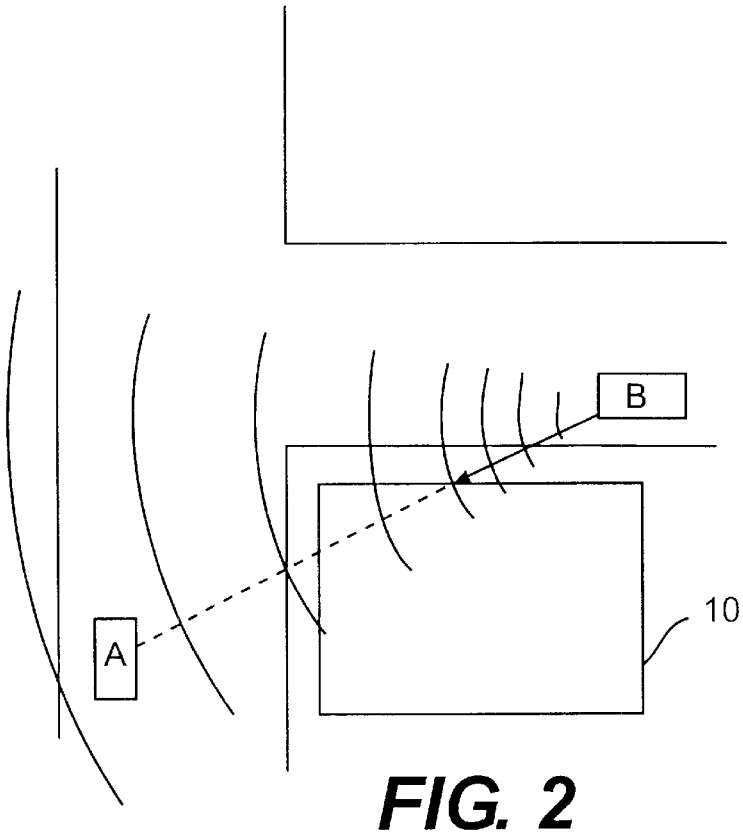
FIG. 2 is a diagram showing a top view of a typical running state of vehicles.

The present invention will become more apparent from the following detailed description of preferred embodiments with reference to FIGS. 1 and 2.

In a movable body detecting/notifying system of the present invention, vehicles and movable bodies including pedestrians each has a communication/notification apparatus 1 mounted thereon.

In the communication/notification apparatus 1 according to a first embodiment of the present invention, a communication control circuit 2 gives a transmission command to a transmitting circuit 3 and inputs a signal received by a receiving circuit 4, outputting a signal based on a result of signal processing to a notifying unit 5.

After receiving a transmission command from the communication control circuit 2, the transmitting circuit 3 transmits a large-wavelength electromagnetic wave which is easily diffractable by an obstruction through a transmitting antenna 3*a* and a small wavelength electromagnetic wave which is not easily diffractable by an obstruction through a transmitting antenna 3*b*. Examples of small-wavelength electromagnetic waves are a microwaves and infrared rays.

An ID code identifying a movable body transmitting a large-wavelength electromagnetic wave and a small-wavelength electromagnetic wave is added to the large-wavelength and small-wavelength electromagnetic waves.

It should be noted that since a small wavelength electromagnetic wave exhibits directivity, a small-wavelength electromagnetic wave is transmitted, scanning a necessary range having a shape resembling doors.

A receiving circuit 4 is capable of receiving both the large-wavelength and small-wavelength electromagnetic waves through a receiving antenna 4*a*, supplying signals to the communication control circuit 2. A notifying unit 5 turns a display lamp on and off, and outputs an audio notice through a speaker.

An explanation of a first example will now be given as to how notification is controlled. As shown in FIG. 2, vehicle A is running toward a crossing of a T-shaped road, while vehicle B is running along a branch road of the T-shaped road also toward the crossing.

In the following description, vehicles A and B are detecting and detected movable bodies, respectively. A movable body detecting/notifying apparatus 1 employed in vehicle B transmits both large-wavelength and small-wavelength electromagnetic waves each having an ID code of vehicle B added thereto.

When vehicles A and B arrive at locations in a relation similar to that shown in FIG. 2, the driver of vehicle A cannot see vehicle B since vehicle B is hidden from the field of vision of vehicle A by a building 10 located at the corner of the T-shaped road.

The large-wavelength electromagnetic wave transmitted by vehicle B is easily diffracted by the building 10 and received by vehicle A. On the other hand, the small-wavelength electromagnetic wave is obstructed by the building 10 and cannot be received by vehicle A.

Thus, the communication control circuit 2 employed in vehicle A receives only the large-wavelength electromagnetic wave, outputting a caution signal to the notifying unit 5 after forming a judgment that vehicle B is hidden by an obstruction.

After receiving the caution signal, the notifying unit 5 turns on the display lamp and outputs a continuous sound through a buzzer to generate a caution notice.

The caution notice informs the driver of the existence of a vehicle under the shadow of an obstruction, allowing the driver to take preparatory action such as application of the brake instead of the accelerator.

As vehicles A and B further approach each other, vehicle B appears from the shadow of the building 10 and is visible by vehicle A. At that time, the small-wavelength electromagnetic wave reaches the detecting vehicle A so that the communication control circuit 2 of vehicle A receives the small-wavelength electromagnetic wave in addition to the large-wavelength electromagnetic wave. If the ID codes included in the small-wavelength and large-wavelength electromagnetic waves are found to match each other, the communication control circuit 2 determines that vehicle B appears from the shadow of an obstruction, existing at a location verifiable by the sense of sight, and outputs a warning signal to the notifying unit 5.

After receiving the warning signal, the notifying unit 5 puts the display lamp in a blinking state and the buzzer in an intermittently operating state in order to generate a warning. The warning informs the driver of the fact that vehicle B has appeared from the shadow of an obstruction, allowing the driver to decelerate or halt vehicle A.

Figure 3:
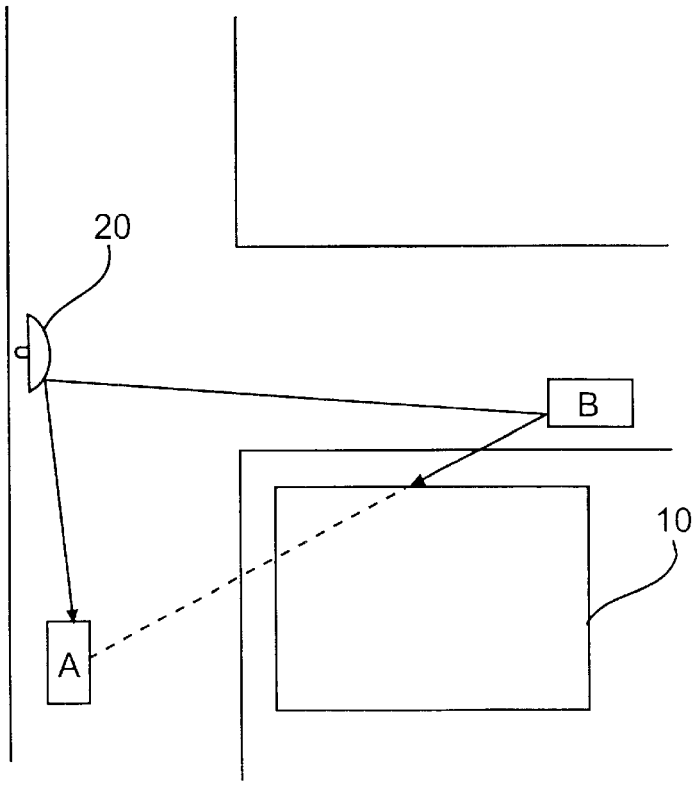
FIG. 3 is a diagram showing a top view of a typical running state of vehicles each employing a movable body detecting/notifying system according to the present invention.

An explanation of a second example will now be given with reference to FIG. 3. FIG. 3 also includes a simplified diagram with a T-shaped road. As shown in the figure, a wave repeater 20 is installed at the cross of the T-shaped road. The wave repeater 20 amplifies a received wave, and reflects and retransmits the wave in a direction forming an angle of about 90 degrees with a direction in which the wave is received.

The wave repeater 20 also adds a relay code to the retransmitted wave to indicate that the wave has phased through the repeater 20. In this embodiment, a transmitting circuit of a movable body is used only for transmitting a small-wavelength electromagnetic wave. The rest of the configuration is the same as the embodiment described earlier.

As vehicles A and B arrive at locations in a relation similar to that shown in FIG. 3, as is the case with the embodiment explained earlier, a small-wavelength electromagnetic wave transmitted by vehicle B is obstructed by the building 10, being unable to reach vehicle A directly. However, the small-wavelength electromagnetic wave is relayed by the wave repeater 20 so it can reach vehicle A eventually.

Thus, vehicle A receives only the small-wavelength electromagnetic wave having a relay code added thereto. As a result, the communication control circuit 2 judges vehicle B to be hidden by an obstruction, generating a caution notice.

As vehicle B appears from the shadow of the building 10 to the visual field of vehicle A, the small wavelength electromagnetic wave is capable of arriving at vehicle A directly. As a result, both the small-wavelength electromagnetic wave including no relay code and the small-wavelength electromagnetic wave including the relay code are received by vehicle A. The ID codes of the small-wavelength electromagnetic wave including no relay code and the small-wavelength electromagnetic wave including the relay code matching each other indicate that both the waves are transmitted by vehicle B. In this case, a warning is generated to indicate that vehicle B exists at a position that can be verified by the sense of sight.

While vehicle B is running under the shadow of an obstruction, the driver of vehicle A is urged to take preparatory action by a caution. As vehicle B appears from the shadow of the obstruction, the driver of vehicle A is urged to decelerate or halt vehicle B by a warning.

In the embodiment described above, the wave repeater 20 relays a wave generated by vehicle B, allowing the existence of vehicle B under the shadow of the building 10 to be detected. As an alternative, a traffic regulating center notifies a vehicle of the state of surrounding movable bodies. When a vehicle is informed by the traffic regulating center of the existence of another movable body, the vehicle is capable of forming a judgment as to whether the other movable body is hidden under the shadow of an obstruction or exists at a position verifiable by the sense of sight by determining whether or not a small-wavelength electromagnetic wave transmitted by the other movable body is received.

To be more specific, when the vehicle is informed by the traffic regulating center of the existence of another movable body but a small-wavelength electromagnetic wave transmitted by the other movable body is not received, the vehicle generates a caution to indicate that the other movable body is hidden under the shadow of an instruction. When the vehicle is informed by the traffic regulating center of the existence of another movable body and a small-wavelength electromagnetic wave transmitted by the other movable body is received, the vehicle generates a warning to indicate that the other movable body is appearing from the shadow of the obstruction.

Another aspect of the present invention implementing the movable body detecting/notifying system will now be explained with reference to FIG. 4.

Figure 4:
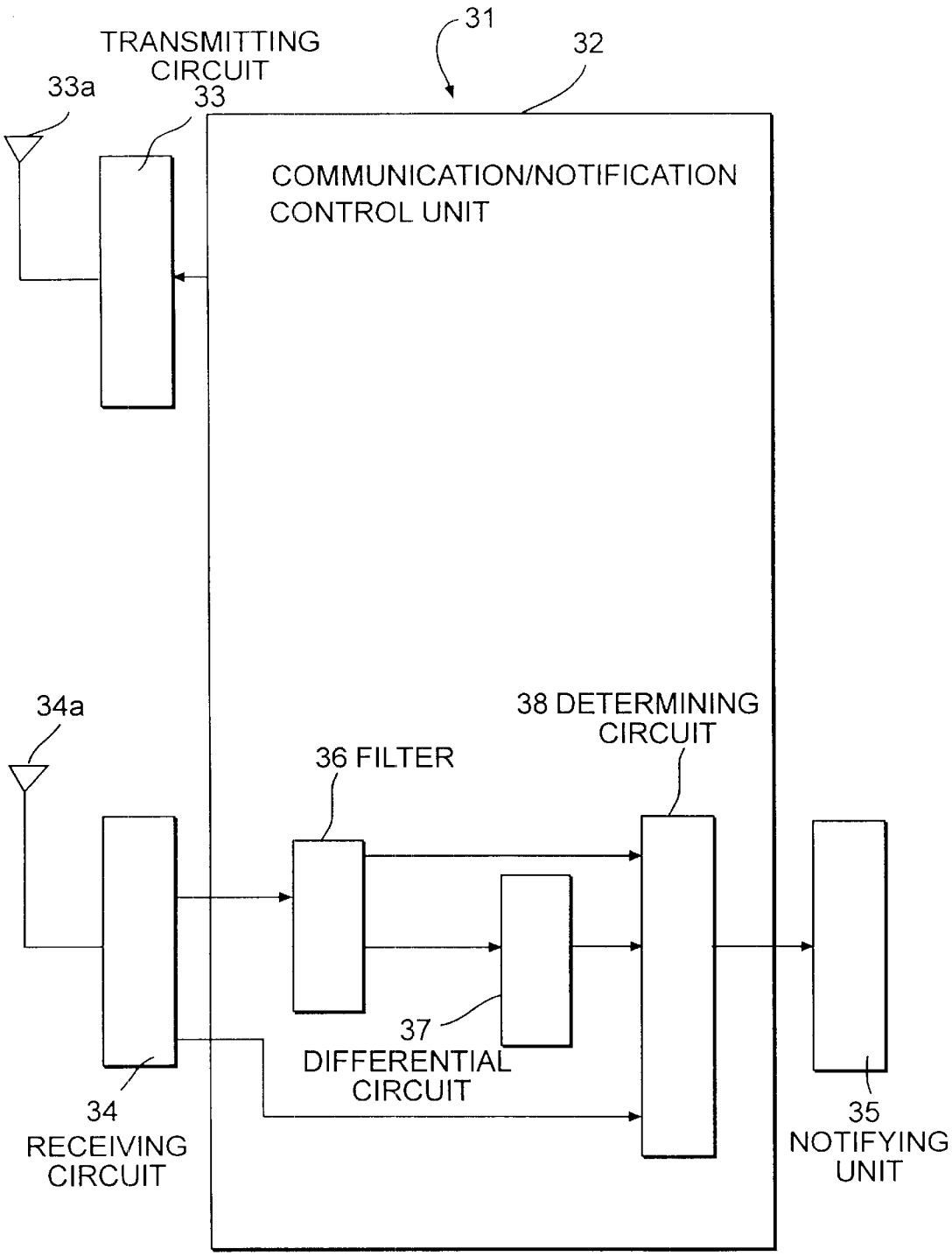
FIG. 4 is a block diagram showing a communication/notification apparatus according to the present invention.

In a movable body detecting/notifying apparatus 31 shown in FIG. 4, a communication/notification control unit 32 gives a transmission command to a transmitting circuit 33, inputs a signal received by a receiving circuit 34 and outputs a signal based on a result of signal processing to a notifying unit 35.

After receiving a transmission command from the communication/notification control unit 32, the transmitting circuit 33 transmits an electromagnetic wave with a wavelength diffractable to a certain degree by an obstruction through a transmitting antenna 33*a*. The communication/notification control unit 32 also analyzes as well as processes an electromagnetic wave picked up by a receiving antenna 34*a* and then passed on to the receiving circuit 34.

To be more specific, an electromagnetic wave received by the receiving circuit 34 in supplied to a filter 36 for removing unwanted things such as noise, ripples and peaks from the wave before being supplied to a determining circuit 38 and a differential circuit 37. In the differential circuit 37, variations of a detected intensity are removed and a signal output by the differential circuit 37 is supplied to the determining circuit 38.

The determining circuit 38 also receives a signal directly from the receiving circuit 34.

When another movable body is hidden under the shadow of an obstruction, the received intensity of an electromagnetic wave transmitted by the movable body is small. This is because the electromagnetic wave diffractable by the obstruction to a certain degree is captured, allowing the determining circuit 38 to determine that the other movable body exists. In this case, a warning signal is output to the notifying unit 35 which in turn generates a caution.

As the other movable body appears from the shadow of the obstruction, a large difference between the intensities of the electromagnetic wave detected before and after the appearance is observed. The large difference between the detected intensities is converted by the differential circuit 31 into a very large positive value which is supplied to the determining circuit 38. If this very large positive value representing a change in detected intensity is sufficiently larger than values received so far, the determining circuit 38 determines that the other movable body appears from the shadow of the obstruction, outputting a warning signal to the noting unit 35 which in turn generates a warning.

As a result, when the other movable body is running under the shadow of an obstruction, the driver of this vehicle is urged to take preparatory action by a caution. As the other movable body appears from the shadow of the obstruction, the driver is urged to decelerate or halt the vehicle by a warning.

Figure 5:
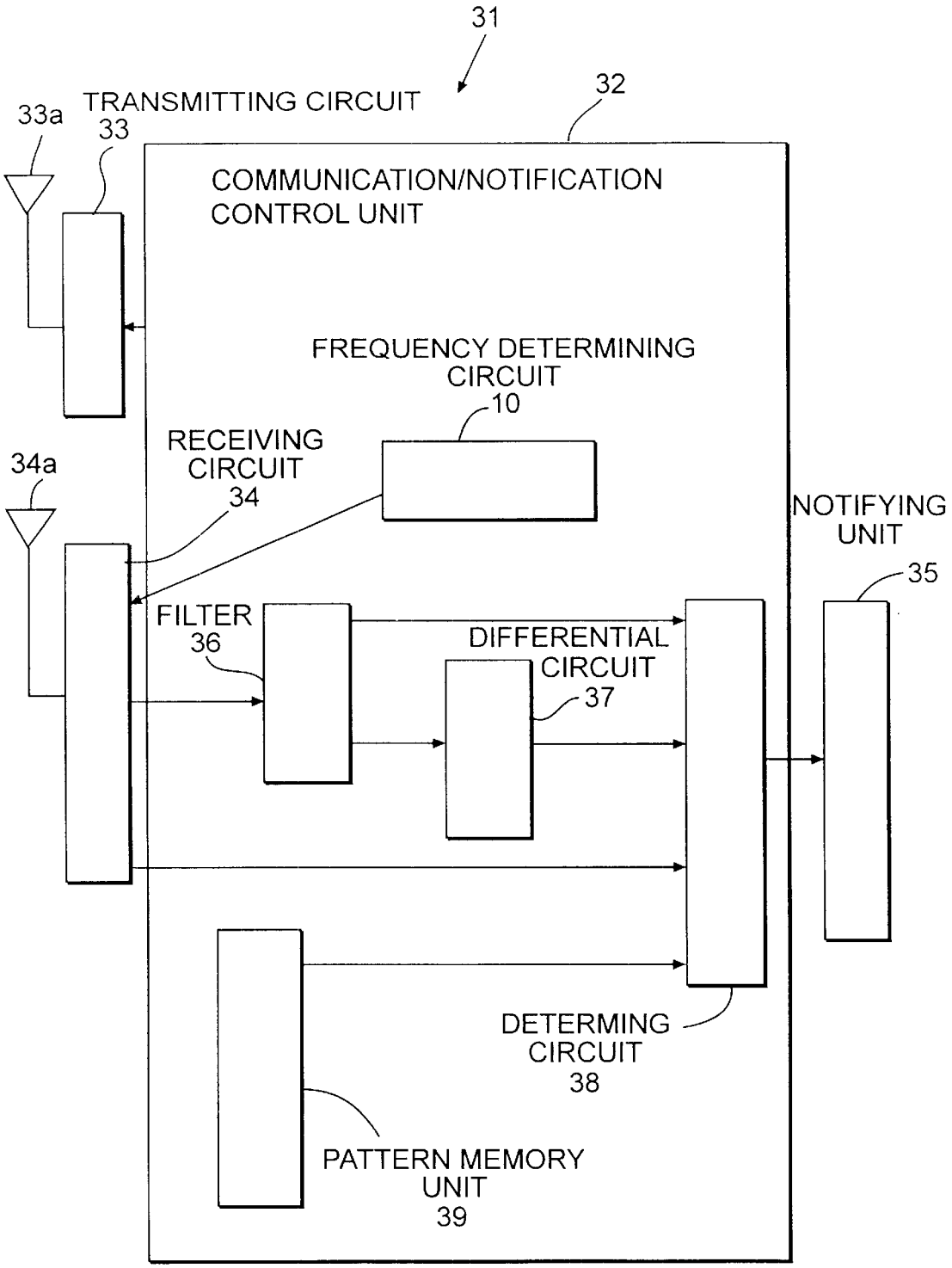
FIG. 5 is a block diagram showing a movable body detecting/notifying apparatus according to the present invention.

A second embodiment of the present invention will now be described with reference to FIG. 5. FIG. 5 is a block diagram showing a movable body detecting/notifying apparatus 31 according to the present invention.

The second embodiment of the present invention is substantially similar to the embodiment of FIG. 4. However, the communication/notification control unit 32 also has a pattern memory unit 39 for storing in advance a variable pattern of a detected intensity of an electromagnetic wave which is received when a movable body transmitting the electromagnetic wave disappears from detection behind an obstruction. The variable pattern of a detected intensity of an electromagnetic wave stored in the pattern memory unit 39 is supplied to the determining circuit 38.

Figure 6A:
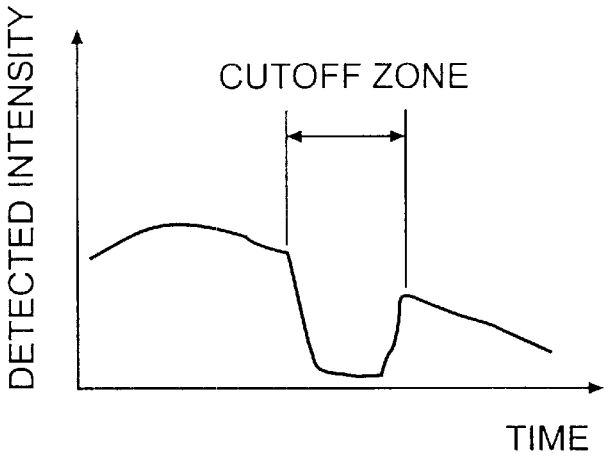
FIGS. 6(*a*)–6(*c*) are diagrams each showing a variable pattern of a detected intensity.
Figure 6B:
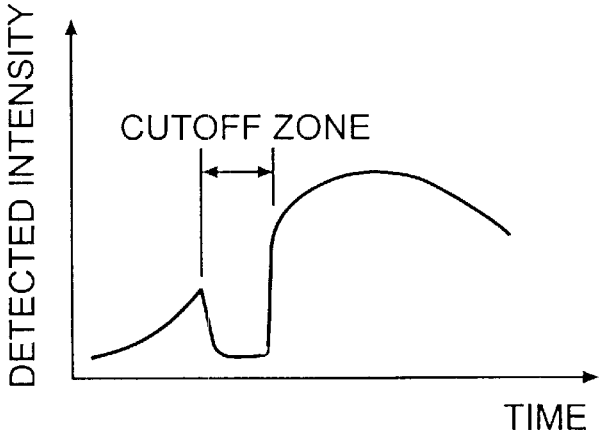
Figure 6C:
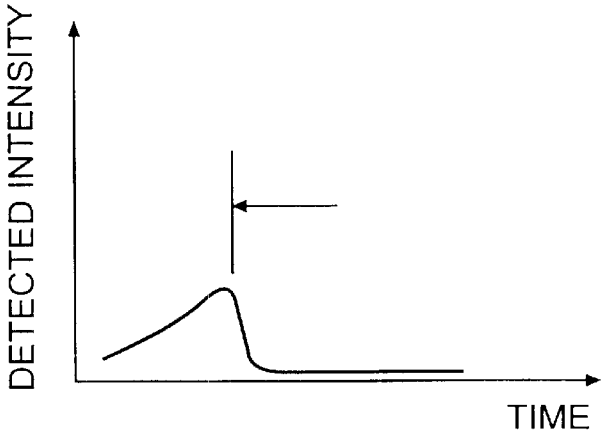

FIG. 6 includes diagrams each showing a variable pattern of a detected intensity of an electromagnetic wave stored in the pattern memory unit 9.

A zone with a dropped detected intensity is a zone in which a movable body disappears from detection behind an obstruction.

FIG. 6(*a*) is a diagram showing a typical case in which another movable body disappears from detection behind an obstruction temporarily while the movable body is moving in a direction away from the driver. On the other hand, FIG. 6(*b*) is a diagram showing a typical case in which another movable body disappears from detection behind an obstruction temporarily while the movable body is moving in a direction approaching the driver. It should be noted that FIG. 6(*c*) is a diagram showing a case in which another movable body goes to a by-road.

The determining circuit 38 compares variations in detected intensity extracted by the differential circuit 37 from an electromagnetic wave received by the receiving circuit 34 with the variable patterns shown in FIG. 6 to determine whether or not the variations match one of the patterns.

If the determining circuit 38 determines that the variations match one of the variable pattern shown in FIG. 6(*a*) or 6(*b*), the determining circuit 38 judges that the movable body has disappeared from detection behind an obstruction temporarily, outputting a warning-notification command to the notifying unit 35. After receiving the command, the notifying unit 35 generates an alarm voice and displays an alarm message on a screen.

To be more specific, when a warning-notification command is received from the determining circuit 38, the notifying unit 35 generates an alarm voice saying: "At the present time, notification can not be carried out reliably so be careful." At the same time, a literal alarm message having the same contents as the alarm voice is displayed on the screen.

It should be noted that a warning sound can be generated by using a buzzer in place the alarm voice and a display lamp can be put in a blinking state in place of the displayed literal alarm message As described above, when the movable body is judged to have disappeared from detection behind an obstruction temporarily, the driver is notified of an alarm so as to make the driver always aware of the existence of a movable body disappearing from detection behind an obstruction and to urge the driver to be on the alert. Thus, a careless attitude of the driver can be avoided and the driver can be prevented from becoming bewildered even if the movable body reappears all of a sudden.

As the movable body reappears from the shadow of the obstruction, the detected intensity is recovered. The determining circuit 38 recognizes this recovery, requesting the notifying unit 35 to halt the warning notification. At the same time, the determining circuit 38 generates a voice and displays a message to indicate the fact that the movable body has reappeared from the shadow of the obstruction.

It should be noted that, in case the movable body does not reappear from the shadow of the obstruction even after a predetermined period of time has lapsed, the determining circuit 38 determines that it is possible that the movable body has exited to a by-road in a direction away from the driver. Therefore, the warning notification is halted.

In addition, the communication/notification control unit 32 has a frequency determining circuit 10 for counting the number of times the determining circuit 38 determines that variations in detected intensity match one of the variable patterns stored in the pattern memory unit 39 in order to form a judgment as to whether a matching frequency is high or low. The matching frequency is said to be high when the number of times the determining circuit 38 determines that variations in detected intensity match one of the stored variable patterns within a predetermined period of time is high.

When the frequency determining circuit 10 judges that the matching frequency is high, the reception sensitivity of the receiving circuit 4 is lowered.

In the case of a high matching frequency as judged by the frequency determining circuit 10, the warning notification urging a caution is repeated frequently and becomes confusing, adversely causing the driver to become unaware of the warning notification. In such a case, the number of times the determining circuit 38 determines that variations in detected intensity match one of the stored variable patterns is deliberately reduced by lowering the sensitivity of the receiving circuit 34. In this way, it is possible to prevent the warning notification urging a caution from being repeated frequently.

As described above, the frequency determining circuit 10 controls the sensitivity of the receiving circuit 4. As an alternative, it is also possible to set a high threshold value used by the determining circuit a as a criterion as to whether or not the intensity which is detected when the movable body reappears from the shadow of an obstruction has been restored to the value observed prior to the disappearance.

By increasing the threshold value, it is possible to prevent the warning notification urging a caution from being repeated frequently.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

I claim:

1. A movable body detecting/notifying system for allowing a detecting movable body to detect and report a detected movable body by using electromagnetic wave communication, comprising:

means mountable to the detected movable body for transmitting a small-wavelength electromagnetic wave not easily diffractable by an obstruction;

a repeater for receiving said small-wavelength electromagnetic wave and adding a relay code thereto, said repeater relaying said small-wavelength electromagnetic wave with said relay code added thereto in a predetermined direction;

when the detecting movable body receives said small-wavelength electromagnetic wave, said detecting movable body determines whether or not a relay code has been added to said small-wavelength electromagnetic wave; and means mountable to the detecting movable body for generating a first notice for reception of the small-wavelength electromagnetic wave with no relay code added thereto or a second notice for reception of the small-wavelength electromagnetic wave with the relay code added thereto.

2. The movable body detecting/notifying system according to claim 1, wherein said first notice is different from said second notice.

3. The movable body detecting/notifying system according to claim 1, wherein an ID code for identifying the detected movable body is added to said small-wavelength electromagnetic wave generated by the detected movable body.

* * * * *